US005732991A

United States Patent [19]

Tsui

[11] Patent Number: 5,732,991

[45] Date of Patent: Mar. 31, 1998

[54] CAST ARTIFACT HANDLING ASSEMBLY

[75] Inventor: Gary Tsui, San Gabriel, Calif.

[73] Assignee: CBC Industries, Inc., City of Commerce, Calif.

[21] Appl. No.: 621,860

[22] Filed: Mar. 25, 1996

[51] Int. Cl.[6] ..... B66C 1/66

[52] U.S. Cl. ..... 294/89; 294/1.1; 52/125.5; 52/705

[58] Field of Search ..... 294/1.1, 82.1, 294/89; 403/60, 78, 164; 52/124.2, 125.2, 125.4, 125.5, 701, 704, 705, 707; 410/101

[56] References Cited

U.S. PATENT DOCUMENTS

| | | | |
|---|---|---|---|
| 806,408 | 12/1905 | Farrington | 294/89 |
| 938,073 | 10/1909 | Percival | 52/705 |
| 1,311,646 | 7/1919 | Gordon | 52/705 |
| 2,674,485 | 4/1954 | Jamison | 294/1.1 |
| 3,456,547 | 7/1969 | Strong | 294/89 |
| 3,561,307 | 2/1971 | Aackersberg | 52/707 |
| 4,615,554 | 10/1986 | Schilla et al. | 294/89 |

*Primary Examiner*—Dean Kramer
*Attorney, Agent, or Firm*—Bruce A. Jagger

[57] ABSTRACT

A concrete artifact handling assembly which includes a threaded socket embedded and anchored in the concrete artifact at least three diameters below the surface thereof, and a safety hoist ring threadably received in the threaded socket and snugged down against the face of the artifact. The thread element of the socket generally having a round thread form.

5 Claims, 1 Drawing Sheet

CAST ARTIFACT HANDLING ASSEMBLY

BACKGROUND OF THE INVENTION

1. Field of the Invention

The invention relates in general to cast artifact handling systems, and, in particular, to cast concrete artifacts comprising safety hoist rings mounted in threaded sockets which are embedded in and anchored to the cast concrete artifacts.

2. Description of the Prior Art

Various molded or cast artifacts, particularly those made of concrete, are routinely lifted, moved, transported, or otherwise handled. Often such objects or artifacts are large, heavy and awkward to handle. Various expedients had been proposed to facilitate the handling of such objects, including, for example, casting threaded inserts into the concrete, which inserts had been adapted to threadably receive I-bolts or studs. Attachments had been made to the I-bolts or studs in an effort to facilitate the handling of the cast artifacts. Such attachment arrangements lacked in both safety and strength. Such threaded inserts had comprised helically wound cylindrical steel rod welded to anchor members. This conventional thread form is sometimes referred to as a coil thread. The threaded inserts and associated anchors had been adapted to being buried beneath the surface of the cast body.

Conventional full swivel, full pivot, hoist rings had been proposed for use in lifting various heavy loads such as, for example, large dies and fixtures, heavy equipment, mobile equipment, structural elements, and cargo. It had been proposed to embed the shank of a safety hoist ring in concrete, see, for example, Tsui et al U.S. Pat. No. 4,705,422.

Conventional full pivot, full swivel hoist rings are generally described herein as "safety hoist rings". Such a safety hoist ring is described, for example, in detail in Tsui et al U.S. Pat. No. 4,705,422, which description is hereby incorporated herein by reference. Generally such safety hoist rings had been provided with mounting screws which had conventional SAE threads. The safe and effective usage of such conventional safety hoist rings depends upon their being mounted firmly against a solid surface. Thus, the longitudinal axis of the mounting screw of a safety hoist ring extends generally normal to a face or flange of the safety hoist ring. This face or flange is adapted to bear firmly against the surface of the object to which the hoist ring is mounted. During assembly the mounting screw is torqued down firmly so that the flange bears against the surface quite firmly. It had been assumed, inter alia, that somewhat irregular cast surfaces, such as that normally present on concrete, would not reliably permit the use of safety hoist rings in place of conventional I-bolts and studs, because, inter alia, the strength and safety of a safety hoist ring, unlike studs and conventional I-bolts, depends in part on being torqued down very firmly against the surface of the object to which it is attached.

Previous systems for the handling of cast artifacts had posed significant safety and control problems. The I-bolts, studs and other expedients which had been used as attachment points for cast artifacts had been limited as to strength. This necessitated the use, with very heavy loads, of several attachment points with resultant complexity, difficulty and expense. Also, because of inherent design deficiencies, such previous systems had posed some significant safety risks by reason, inter alia, of unexpected failures during use.

Those concerned with these problems recognize the need for an improved cast artifact handling system or assembly.

BRIEF SUMMARY OF THE INVENTION

A preferred embodiment of the cast artifact handling assembly according to the present invention comprises a steel threaded socket, and associated anchor, embedded within a cast or molded artifact which is generally concrete. The thread generally has a round or coil thread form although less preferred angular thread forms may be used, if desired. The high tensile strength steel mounting screw of a safety hoist ring is provided with a mating round form thread and is threadably received in the threaded socket. The mounting screw is torqued down so that the flange of the safety hoist ring is drawn firmly against the generally irregular surface of the cast artifact. The term "cast" as used herein will be understood to include cast and molded artifacts.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of handling systems or assemblies for cast or molded artifacts. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE PREFERRED EMBODIMENTS

Figure 1:
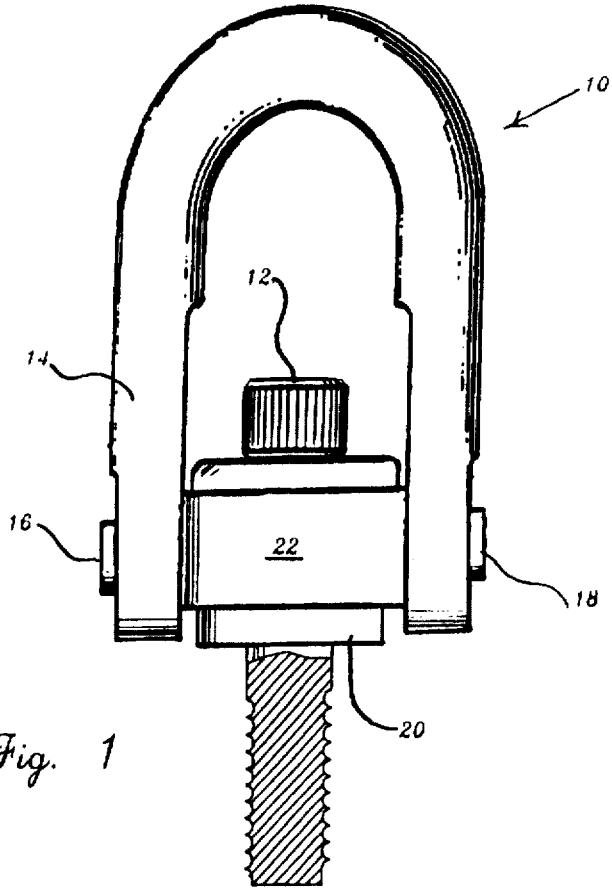
FIG. 1 is a plan view partially in cross-section of a safety hoist ring in which the mounting screw has a coil thread.
Figure 2:
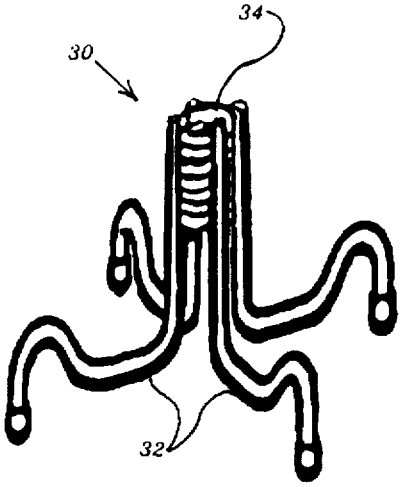
FIG. 2 is an isometric view of a conventional threaded socket with round form thread and associated anchor legs for embedding in a cast artifact.
Figure 3:
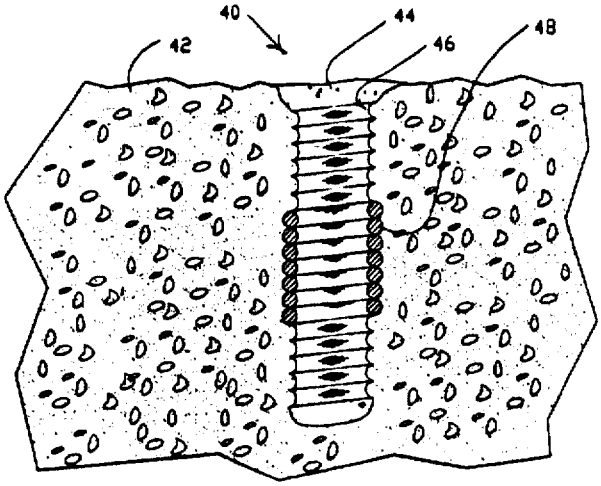
FIG. 3 is a broken cross-sectional view of a threaded socket embedded within a cast concrete artifact.

Referring now to the drawings wherein like reference numerals designate identical or corresponding parts throughout the several views, there is illustrated generally at 10 a safety hoist ring which has a mounting screw 12 which is provided with a round thread form. A U-bar 14 provides a loop which is adapted to engage with a conventional lifting member such as a hook, not shown. U-bar 14 is pinned to retention ring 22 by means of shoulder pins 16 and 18. Flange 20 is adapted to bear against the surface, for example, 42, of the cast artifact to which the safety hoist ring 10 is mounted. U-bar 14 is mounted so that it is free to pivot around mounting screw 12, within a plane which is normal to the longitudinal axis of mounting screw 12, as well as about shoulder pins 16 and 18. As will be understood by those skilled in the art, mounting screw 12 may be threaded for its full length, if desired.

The combined threaded socket and anchor member indicated generally at 30 includes a socket 34 which is formed of a coil of round wire so as to define a round thread form. Anchor legs 32 are secured to socket 34, for example, by welding. Anchor legs 32 are adapted to extend into a cast mass of material so as to prevent their being pulled therefrom. Anchor legs 32 serve to hold socket 34 in a cast artifact.

The cast concrete artifact indicated generally at 40 includes an irregular surface 42 in which an opening 44 leads to a threaded hole 46. A round thread form socket 48 is embedded within the cast artifact. Socket 48 is anchored within the cast artifact by means of anchoring elements or legs, not shown. Socket 48 is adapted to threadably receive the threaded shank 12 of safety hoist ring 10. It has been found that the flange 20 can be drawn down snugly against surface 42 and substantially the full rated load of the hoist ring can be used provided the entry end of socket 48 is located at least two and preferably at least three diameters below the surface 42. The diameter involved is the major diameter of the thread element.

What has been described are preferred embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described.

What is claimed is:

1. A cast artifact handling assembly comprising:

a solid cast body of concrete having a surface;

a threaded socket comprising a rod formed into a helix and embedded within said solid cast body, said threaded socket including an entry end and a high strength female thread element, the entry end of said threaded socket being embedded below said surface to a depth of at least twice the major diameter of the thread element and accessible from outside of said solid cast body;

a threaded socket anchor embedded within said solid cast body and affixed to said threaded socket; and a safety hoist ring, said safety hoist ring including a mounting screw having a high strength male thread element threadably mated with said female thread element and drawn snugly against said surface.

2. A cast artifact handling assembly of claim 1 wherein said thread elements comprise generally round form thread elements.

3. A cast artifact handling assembly of claim 1 wherein said rod is generally cylindrical.

4. A cast artifact handling assembly of claim 1 wherein said threaded socket comprises a rod formed into a helix with the thread form of said thread elements being defined by the cross-sectional shape of the rod.

5. A cast artifact handling assembly comprising:

a solid cast concrete body having a first surface;

a threaded socket having an entry end and being cast within said solid cast concrete body and accessible from said first surface, said threaded socket including a high strength female thread element, the entry end of said threaded socket being embedded at least three diameters below said first surface, said threaded socket comprising a rod formed into a helix, the thread form of said thread element being generally defined by the cross-sectional shape of said rod;

a threaded socket anchor cast into said solid cast concrete body and affixed to said threaded socket; and a safety hoist ring, said safety hoist ring including a mounting screw having a longitudinal axis and a high strength male thread element threadably mated with said female thread element, said safety hoist ring including a flange extending generally normal to said longitudinal axis, said flange being threadably drawn by said mounting screw firmly against said first surface.

* * * * *